US006928757B2

(12) United States Patent
Bloxdorf et al.

(10) Patent No.: US 6,928,757 B2
(45) Date of Patent: Aug. 16, 2005

(54) SNOWPLOW MOUNTING ASSEMBLY

(75) Inventors: David N. Bloxdorf, Hubertus, WI (US); Chad T. Barker, Caledonia, WI (US); James R. Doornek, Mequon, WI (US); Steven L. Klug, Union, ME (US); Steven P. Radomski, Milwaukee, WI (US)

(73) Assignee: Douglas Dynamics, L.L.C., Milwaukee, WI (US)

( * ) Notice: Subject to any disclaimer, the term of this patent is extended or adjusted under 35 U.S.C. 154(b) by 0 days.

(21) Appl. No.: 10/339,116

(22) Filed: Jan. 9, 2003

(65) Prior Publication Data

US 2003/0093927 A1 May 22, 2003

Related U.S. Application Data

(62) Division of application No. 09/684,269, filed on Oct. 6, 2000, now Pat. No. 6,526,677.

(51) Int. Cl.[7] ..... E01H 5/04
(52) U.S. Cl. ..... 37/231
(58) Field of Search ..... 37/231, 234, 235, 37/236, 266, 270; 172/272, 274, 275, 212, 395

(56) References Cited

U.S. PATENT DOCUMENTS

| | | | |
|---|---|---|---|
| 1,890,730 | A | 12/1932 | Hunt |
| 1,918,771 | A | 7/1933 | Meyer |
| 2,057,326 | A | 10/1936 | Coates |
| 2,119,263 | A | 5/1938 | Baumgardner |
| 2,141,558 | A | 12/1938 | Richter |
| 2,426,410 | A | 8/1947 | Owen |
| 2,565,337 | A | 8/1951 | Allan |
| 2,577,145 | A | 12/1951 | Nearing et al. |

(Continued)

FOREIGN PATENT DOCUMENTS

| | | |
|---|---|---|
| CA | 916646 | 12/1972 |
| CA | 1182638 | 2/1985 |
| CA | 1220022 | 4/1987 |
| CA | 1253003 | 4/1989 |
| CA | 2023065 | 10/1991 |
| CA | 2027411 | 4/1992 |

(Continued)

OTHER PUBLICATIONS

Northman Snowplows, *Northman Model 2400 Supermount II*, Brochure.
Northman Snowplows, *Mounting Styles*, Brochure.
Boss Products, *The Boss Snowplow Rapid Tach II™*, Brochure.
Boss Products, *The Boss Straight Blade Snowplows*, Brochure.
Curtis Tractor Cab Inc., *Curtis Snowplows Hitch–N–Run System™ Sno–Pro® 300 Series*, Brochure, 1999.
Curtis Tractor Cab. Inc., *Curtis Truck Snow Plows Sno–Pro® 3000 Hitch–N–Run System™*, Brochure, 2000.
Hiniker Company, *Hiniker Plows Quick Hitch Mounting System*, Brochure, 1996.
Meyer Products, *Meyer MD II™*, Brochure, 2000.

*Primary Examiner*—Robert E Pezzuto
(74) *Attorney, Agent, or Firm*—Wood, Herron & Evans, LLP

(57) ABSTRACT

In combination a mount frame adapted to be attached to a vehicle and a snowplow assembly. The mount frame comprises a pair of detachable receivers which receive a pair of horns extending rearwardly from the snowplow assembly. The snowplow assembly comprises an A-frame, a trunnion and a lift frame. A blade is attached to the front of the A-frame. A pair of spaced stand assemblies, each including a latching mechanism, support the snowplow assembly when the mount frame is separated from the snowplow assembly. The latching mechanisms secure the snowplow assembly to the mount frame.

18 Claims, 6 Drawing Sheets

U.S. PATENT DOCUMENTS 2,642,294 A 6/1953 Holm
2,662,459 A 12/1953 Shore
2,667,708 A 2/1954 Gjesdahl
2,697,289 A 12/1954 Standfuss
2,703,244 A 3/1955 Nearing
2,710,464 A 6/1955 Husting
3,098,309 A 7/1963 Koch
3,150,884 A 9/1964 Drott
3,157,099 A 11/1964 Ulrich
3,214,136 A 10/1965 Jocher et al.
3,250,026 A 5/1966 Jocher et al.
3,285,625 A 11/1966 Krueger
3,343,850 A 9/1967 Stauss et al.
3,388,929 A 6/1968 Miley
3,410,008 A 11/1968 Standfuss
3,412,489 A 11/1968 Klapprodt et al.
3,427,046 A 2/1969 Sommer et al.
3,434,737 A 3/1969 Bailey et al.
3,483,641 A 12/1969 Hirt
3,512,804 A 5/1970 Siegert
3,528,685 A 9/1970 Eastman
3,531,140 A 9/1970 DiVita et al.
3,605,906 A 9/1971 Coates
3,746,368 A 7/1973 Gledhill et al.
3,760,883 A 9/1973 Birk
3,786,368 A 1/1974 Bjorkholm et al.
3,793,752 A 2/1974 Snyder
3,815,687 A 6/1974 Federspiel
3,822,751 A 7/1974 Waterman
3,851,894 A 12/1974 St. Pierre
3,876,092 A 4/1975 MacDonald
3,987,562 A 10/1976 Deen et al.
4,074,448 A 2/1978 Niemela
4,090,725 A 5/1978 Perin
4,127,951 A 12/1978 Hatch
4,176,727 A 12/1979 Perin
4,187,624 A 2/1980 Blau
4,205,825 A 6/1980 Stanford
4,236,329 A 12/1980 Hetrick
4,249,323 A 2/1981 Malhis et al.
4,253,793 A 3/1981 Braml
4,255,884 A 3/1981 Williams
4,259,794 A 4/1981 Rath
4,265,587 A 5/1981 Clark
4,268,058 A 5/1981 Farrell et al.
4,342,163 A 8/1982 Hoekstra
4,391,052 A 7/1983 Guy, Jr.
4,436,477 A 3/1984 Lenertz et al.
4,439,939 A 4/1984 Blau
4,452,560 A 6/1984 Coyle et al.
4,462,172 A 7/1984 Caron
4,528,762 A 7/1985 Sarka et al.
4,565,018 A 1/1986 Oya
4,574,502 A 3/1986 Blau
4,619,060 A 10/1986 Knowlton
4,658,519 A 4/1987 Quenzi
4,717,166 A 1/1988 Vachon
4,744,159 A 5/1988 Houle
4,747,612 A 5/1988 Kuhn
4,802,293 A 2/1989 Smith
4,807,375 A 2/1989 Iraci
4,817,728 A 4/1989 Schmid et al.
4,821,435 A 4/1989 Pester
4,821,436 A 4/1989 Slocum
4,833,799 A 5/1989 Harte et al.
4,962,599 A 10/1990 Harris
4,976,053 A 12/1990 Caley
4,999,935 A 3/1991 Simi et al.
5,014,452 A 5/1991 Berghefer
5,027,536 A 7/1991 Farrell
5,031,927 A 7/1991 Frenette
5,050,322 A 9/1991 Burkard
5,082,065 A 1/1992 Fletcher
5,088,215 A 2/1992 Ciula
5,094,019 A 3/1992 DeVincenzo
5,111,603 A 5/1992 Knowlton et al.
5,125,174 A * 6/1992 Watson et al. ..... 37/231
5,136,795 A 8/1992 Rosenberg
5,145,313 A 9/1992 Weyer
5,155,929 A 10/1992 Vachon
5,195,261 A 3/1993 Vachon
5,244,047 A 9/1993 Eudy
5,245,771 A 9/1993 Walsh
5,353,530 A 10/1994 Pieper
5,361,519 A 11/1994 Ciula et al.
5,368,409 A 11/1994 Marzullo et al.
5,397,187 A 3/1995 Cachinero et al.
5,415,235 A 5/1995 Gebauer
5,456,030 A 10/1995 Barone et al.
5,485,690 A 1/1996 MacQueen
5,524,368 A 6/1996 Struck et al.
5,568,694 A 10/1996 Capra et al.
RE35,700 E 12/1997 Watson et al.
5,743,339 A 4/1998 Alexander, III
5,778,567 A 7/1998 Jager et al.
5,806,214 A * 9/1998 Behrens et al. ..... 37/231
5,815,956 A 10/1998 Lavin et al.
5,909,960 A 6/1999 Jager et al.
5,915,837 A 6/1999 Brown et al.
5,924,223 A * 7/1999 Hone, Jr. ..... 37/231
6,145,222 A 11/2000 Curtis
6,178,669 B1 1/2001 Quenzi et al.
6,209,231 B1 * 4/2001 Curtis ..... 37/231
6,276,076 B1 8/2001 Quenzi et al.
6,354,024 B1 * 3/2002 Kost et al. ..... 37/231

FOREIGN PATENT DOCUMENTS

CA 1300877 5/1992
CA 1303352 6/1992
CA 1318786 6/1993
CA 2121948 10/1994
CA 2090992 5/1996
CA 2137853 1/1999
DE 1164323 2/1964
DE 1255376 11/1967
FR 1272636 8/1961
FR 1489716 7/1967

* cited by examiner

SNOWPLOW MOUNTING ASSEMBLY

This application is a divisional of Ser. No. 09/684,269 filed Oct. 6, 2000, now U.S. Pat. No. 6,526,677 issued Mar. 4, 2003

FIELD OF THE INVENTION

This invention relates to snow removal equipment and, more particularly, to a snowplow mounting assembly for removably securing a snowplow to a vehicle.

BACKGROUND OF THE INVENTION

Snow removal has been a problem for as long as motorized vehicles have used public roadways for transportation. In response to the task of removing significant quantities of snow away from roadways, driveways and parking lots, many different types of snowplowing arrangements have been invented. Numerous of these snowplows have been configured to remove snow efficiently from a hill or other uneven surface. In addition, many of these snowplows have been built with hydraulics in order to lift the snowplow into and out of engagement with the road surface.

Numerous patents disclose snowplows with one or more pivot axes. U.S. Pat. No. 3,605,906 discloses a snowplow which is capable of rotating about a longitudinally extending axis as well as a transversely extending axis perpendicular to the direction of travel of the vehicle. By fixing the position of the snowplow along these two axes, the snowplow may be moved to a desired position. U.S. Pat. Nos. 3,822,751 and 4,821,436 also disclose snowplows which may be mounted to the front of a vehicle and rotated about at least two axes so as to adjust the snowplow blade to a desired position.

Another desirable feature of a snowplow assembly is a jack stand or lift stand capable of supporting the snowplow assembly when not in use. Several patents disclose snowplow assemblies which have lift stands. Applicants' own U.S. Pat. No. 5,125,174, reissued as U.S. Pat. No. Re 35,700, discloses a snowplow assembly having a lift stand which is pivotable about a horizontal axis and may be lifted out of the way when the snowplow assembly is being used to plow snow.

Another patent which discloses a pivotable support stand is U.S. Pat. No. 3,150,884. This patent discloses a lift stand which is rotated to an upward position out of the way when a pair of ball joints at the front of a pair of rods secured to the vehicle are received within funnel-shaped guides extending rearwardly from a snowplow assembly.

Once a mounting apparatus secured to a vehicle is engaged with a snowplow assembly, it is known to utilize a latch mechanism in order to secure the snowplow assembly to the mount at the front of the vehicle. U.S. Pat. Nos. 5,031,927 and 3,987,562 disclose such latch mechanisms. However, with each of these latch mechanisms a lever must be activated in order to latch the two devices together.

SUMMARY OF THE INVENTION

The invention of this application provides a number of features and advantages over and above the noted prior art and comprises a snowplow mounting assembly comprising two principal elements: a mount frame adapted to be attached to a vehicle and a snowplow assembly removably attachable to the mount frame.

The mount frame of the snowplow mounting assembly comprises a first portion adapted to be attached to a vehicle and a second portion detachable from the first portion. The second portion comprises a pair of spaced receivers, each having a generally rectangular cross-sectional configuration. Each receiver has a top plate, a bottom plate and a pair of laterally spaced side plates. The bottom plate has a depending lip, and at least one of the side plates has a flared portion. A pair of spaced latch pins are located outside of the receivers of the mount frame.

The snowplow assembly of the snowplow mounting assembly is releasably securable to the mount frame located on the front of a vehicle. The snowplow assembly comprises a lift frame, a trunnion and an A-frame. The lift frame is generally vertically oriented and includes a pair of headlights. The trunnion is transversely oriented and pivotable about a first transverse horizontal axis relative to the lift frame. The A-frame is pivotable about a horizontal longitudinally extending axis relative to the trunnion. A snowplow blade is attached to the front end of the A-frame.

The lift frame includes a lifter or hydraulic cylinder, which is used to lift the snowplow blade vertically upward. A chain or other similar structure extends between the front of the A-frame and lift arms pivotably secured to the lift frame. When the hydraulic cylinder is activated, a piston rod pushes the lift arms upwardly causing the chain to pull the blade upwardly.

The lift frame also includes a pair of stand assemblies which are pivotable about a second transversely extending horizontal pivot axis. These stand assemblies are movable between a down position in which the stand assemblies support the snowplow assembly and an up position in which the stand assemblies do not support the snowplow assembly. A latch hook is located on an upper end of each of the stand assemblies. When the stand assemblies are pivoted from their down position toward their up position, the latch hooks move rearwardly and downwardly into engagement with the latch pins of the mount frame to secure the snowplow assembly to the mount frame at the front of a vehicle. A lock pin assembly on each of the stand assemblies is adapted to lock the stand assemblies in either the up position or the down position.

The lift frame further comprises a pair of horns extending rearwardly from the lift frame. The horns of the lift frame are received in the receivers of the mount frame when the snowplow assembly and mount frame are secured together.

Each of the stand assemblies is separately and continuously adjustable in length. This adjustable length feature enables the snowplow assembly to be placed on an uneven surface, such as a hill, in such a position that it can easily be mounted on the front of a vehicle. The driver of the vehicle may drive the receivers of the mount frame into engagement with the horns projecting rearwardly from the lift frame of the snowplow assembly. The driver then manually rotates the stand assemblies about the second transversely extending pivot axis until the latch hooks of the stand assemblies engage the latch pins of the mount frame. Thus, with minimal effort in a minimal amount of time, the driver of the vehicle may secure the snowplow assembly to the mount frame secured to the vehicle and proceed to move snow.

These and other objectives and advantages of the present invention will be more readily apparent from the following drawings.

BRIEF DESCRIPTION OF THE DRAWINGS OF THE INVENTION

DETAILED DESCRIPTION OF A PREFERRED EMBODIMENT OF THE INVENTION

Figure 1:
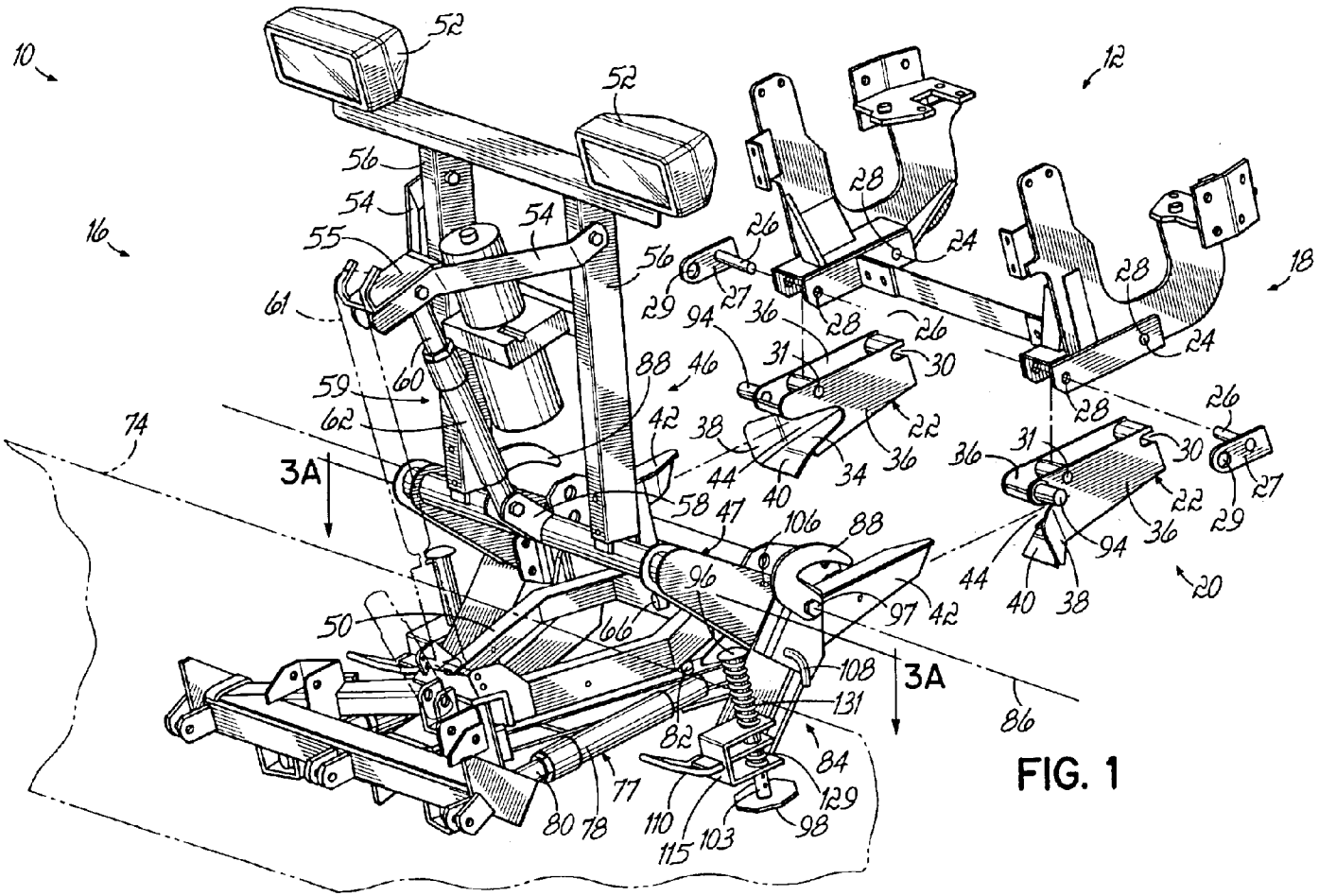
FIG. 1 is an exploded perspective view of the snowplow mounting assembly of the present invention including a mount frame and a snowplow assembly releasably securable to the mount frame.

Referring to the drawings, and particularly to FIG. 1, there is illustrated a snowplow mounting assembly 10 and comprising a mount frame 12 adapted to be secured to a vehicle 14 and a snowplow assembly 16.

As best illustrated in FIG. 1, mount frame 12 comprises a first portion 18 adapted to be attached or secured to the vehicle 14 and a second portion 20 quickly and readily detachable from the first portion 18 without the use of tools, i.e. not requiring wrenches, sockets, removing nuts from bolts, etc. Such a two piece design is advantageous in order that it provides improved, i.e. increased, ground clearance of the mount frame 12 on vehicle 14, and/or increased "approach angle" of the vehicle 14, when snowplow assembly 16 is removed from the vehicle 14 during nonuse, as second portion 20 can also be removed leaving only first portion 18 mounted to the vehicle. The term approach angle refers to the angle between the horizontal road surface and a straight line extending from the tangent point of the front tire contacting the road surface to the mount frame, at whatever mount frame location produces the smallest such angle. Stated otherwise, the approach angle is the angle formed between the road surface and a straight line originating at the tangent point of where the front tire contacts the road surface and swung upwardly to the point where that line first contacts any point on the mount frame. Although one configuration of the first portion 18 of the mount frame 12 is illustrated, this portion may assume numerous other configurations and be attached to a number of different vehicles in numerous ways.

The second portion 20 of the mount frame 12 comprises a pair of receivers 22. Each of the receivers 22 is detachably secured to a respective first portion 18 of the mount frame 12 with a fixed rear pin 24 and a removeable front pin 26. A slot 30 in receiver 22 engages fixed rear pin 24 which is welded to first portion 18 in rearward most hole 28. A through passageway 31 in receiver 22 is aligned with forward most hole 28 in first portion 18 and accepts removeable pin 26. Removeable pin 26 includes a tab 27 fixedly secured thereto with a hole 29 therein that engages over a latch pin 94 secured to receiver 22, which will be described in more detail below. A "hairpin" (not shown) is manually installed in a hole (not shown) in latch pin 94 (without the use of tools) to secure tab 27 on latch pin 94 and consequently to secure pin 26 in passageway 31. Thus no tools, wrenches, sockets, etc are required to quickly and readily detach second portion 20 from first portion 18.

Each of the receivers 22 has a generally rectangular cross-sectional configuration and has a bottom plate 34, a top plate 35 and a pair of opposed, parallel, laterally spaced side plates 36. The bottom plate 34, top plate 35 and side plates 36 define an interior 44 of each receiver 22. Each laterally inboard side plate 36 includes a notch or relief **36*a* extending from a front edge of that side plate 36 rearwardly. A pair of horns 42 extend rearwardly from a lift frame 46 of the snowplow assembly 16. The horns 42 are interconnected by a round tube 43. The horns 42 are received in the receivers 22 and the tube 43 is received in the notches 36*a*. The laterally inboard side plates 36 carry thrust loads from the snowplow assembly 16 transmitted to those side plates 36 by the tube 43, whereas the bottom 34 and top 35 plates carry moment loads from the snowplow assembly 16 transmitted to those plates 34, 35 by the horns 42. The outermost side plate 36 of each receiver 22 has an outwardly flared portion 38, and the bottom plate 34 has a depending lip 40. This lip 40 and flared portion 38 aid in guiding each horn 42 into the interior 44 of its respective receiver 22** in a manner which will be described in more detail below.

Figure 3B:
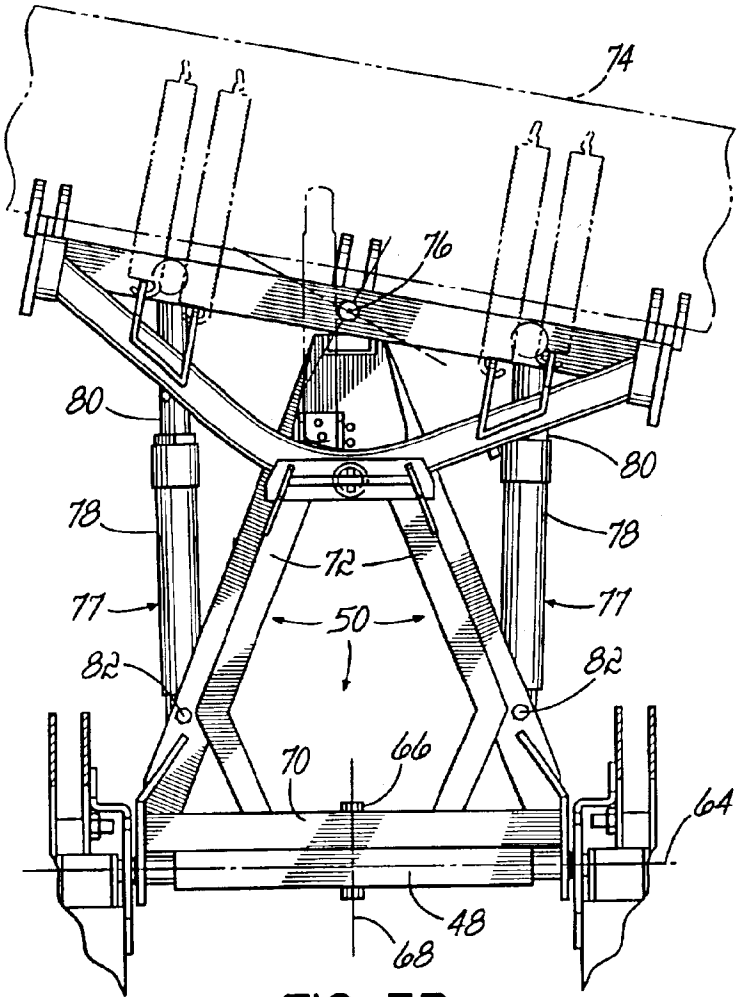
FIG. 3B is a top view of the snowplow assembly of FIG. 3A illustrating the snowplow blade being angled to one side in order to push the snow to one side of the road as the vehicle travels down the road.
Figure 3A:
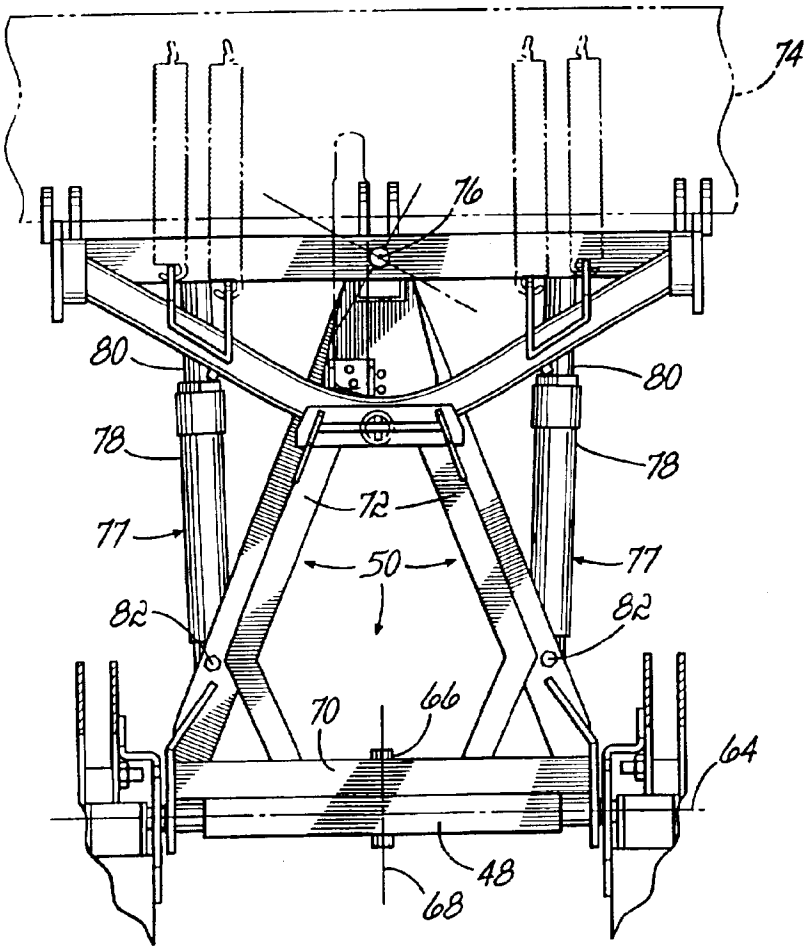
FIG. 3A is a top view of the snowplow assembly of the present invention secured to the mount frame with the snowplow blade being perpendicular to the direction of travel of the vehicle.

The snowplow assembly 16 comprises three principal elements best illustrated in FIGS. 3A and 3B: a lift frame 46, a trunnion 48 and an A-frame 50. For the sake of clarity we will describe each of these elements in detail in the order in which they are located progressing from back to front.

The rearwardmost one of these elements is the lift frame 46 best illustrated in FIG. 1. The lift frame 46 is generally vertically oriented and includes lower portion 47 and a pair of supports 56 extending upwardly from the lower portion 47. A pair of headlights 52 are located at the upper ends of the supports 56. The lift frame 46 further includes a pair of lift arms 54 extending forwardly from vertical supports 56 at the upper ends of the supports 56. The lift arms 54 are joined together with a lift bracket 55. A hydraulically operated lifter 59 comprising piston rod 60 and cylinder 62 extends between the front of the lift arms 54 and a bracket 58 secured to a lower portion of the lift frame 46. This hydraulically operated lifter 59 functions to lift the A-frame 50 from a lowered position illustrated in FIG. 2B to a raised position illustrated in FIG. 2C. When the piston rod 60 of the lifter 59 is activated, the piston rod 60 raises the lift arms 54 causing a chain 61 to lift the front of the A-frame 50, the A-frame 50 and trunnion 48 rotating about first transversely extending axis 64 shown in FIGS. 3A and 3B.

As best illustrated in FIGS. 3A and 3B, the second component of the snowplow assembly 16 is the trunnion 48. The trunnion 48 comprises a transversely extending bar which is pivotable about the prior-mentioned first transversely extending horizontal axis 64 relative to the lift frame 46. When the piston rod 60 of the lifter raises the A-frame 50, both the A-frame 50 and trunnion 48 pivot about the first transversely extending axis 64. As seen in FIGS. 3A and 3B, the trunnion 48 is secured to the A-frame 50 with a bolt 66 or other fastener which defines a longitudinally extending axis 68.

The third and last element of the snowplow assembly is the A-frame 50 best illustrated in FIGS. 3A and 3B. The A-frame 50 comprises a back bar 70 and a pair of side bars 72 arranged in a triangular or "A" configuration. The back bar 70 is secured to the trunnion 48 with the prior-mentioned fastener 66. A snowplow blade 74 is secured to the front of the A-frame 50.

In order to adjust the snowplow blade 74 such that one is able to push the snow to one side of the road, the snowplow blade 74 is pivotable about a vertical axis 76 illustrated in FIGS. 3A and 3B. The snowplow blade 74 is movable about this axis by the operation of a pair of hydraulic adjusters 77. Each adjuster 78 comprises a piston rod 80 extending forwardly from a cylinder 78 in order to push one side of the snowplow blade 74 forwardly relative to the other side of the snowplow blade 74 as illustrated in FIG. 3B.

The rears of the adjusters 78 are secured to the side bars 72 of the A-frame with fasteners 82. Although hydraulic adjusters are illustrated and described, other mechanisms may be used to rotate the snowplow blade 74 about the vertical axis 76 and fix its position.

The A-frame 50 is pivotable about the horizontal longitudinally extending axis 68 relative to the trunnion 48 in order to accommodate further adjustment of the snowplow blade 74 relative to the terrain as will be described below in more detail.

Figure 2A:
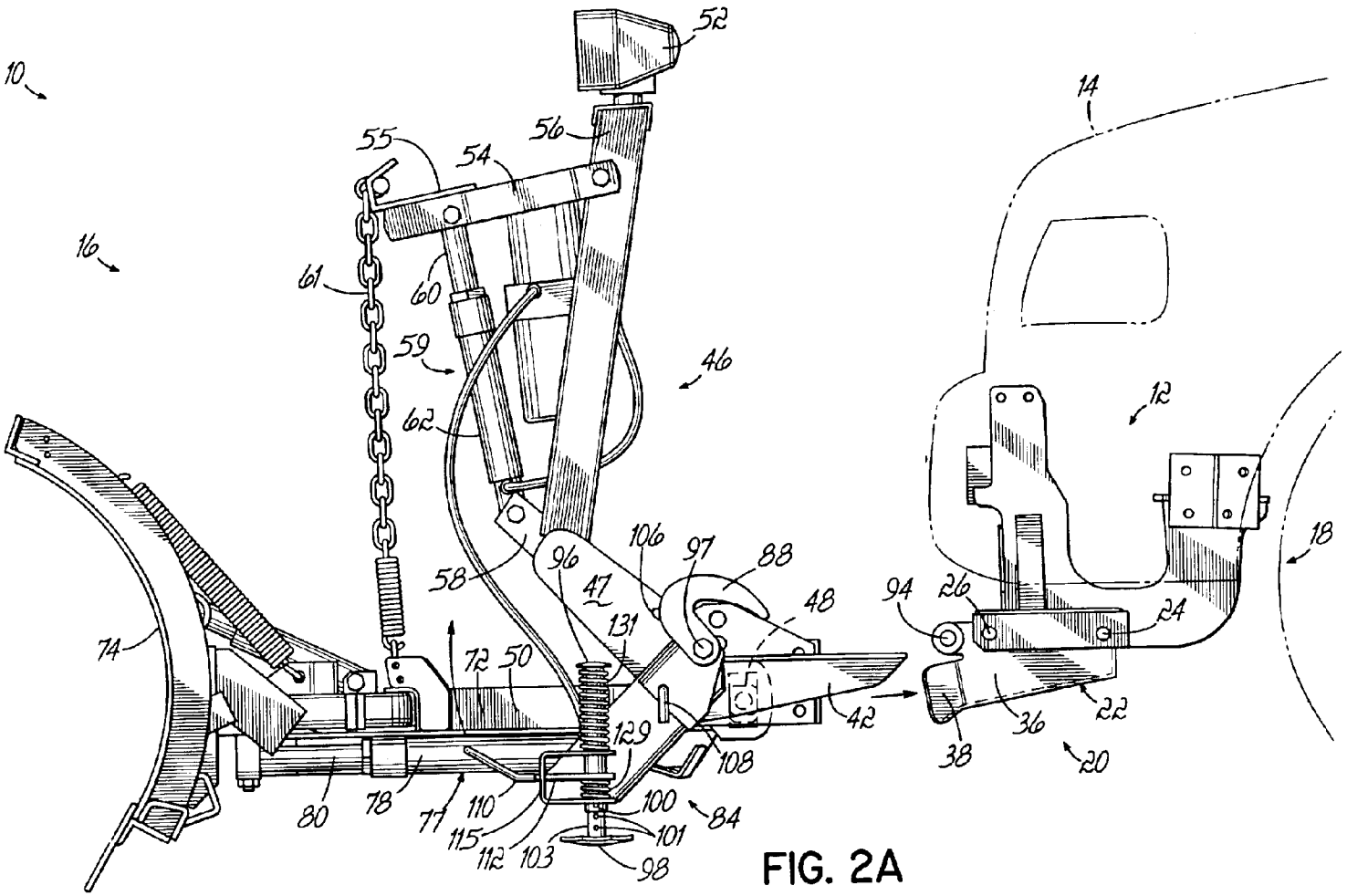
FIG. 2A is a side elevational view of the snowplow mounting assembly of the present invention with the mount frame secured to a vehicle before the mount frame is engaged with the snowplow assembly.
Figure 2B:
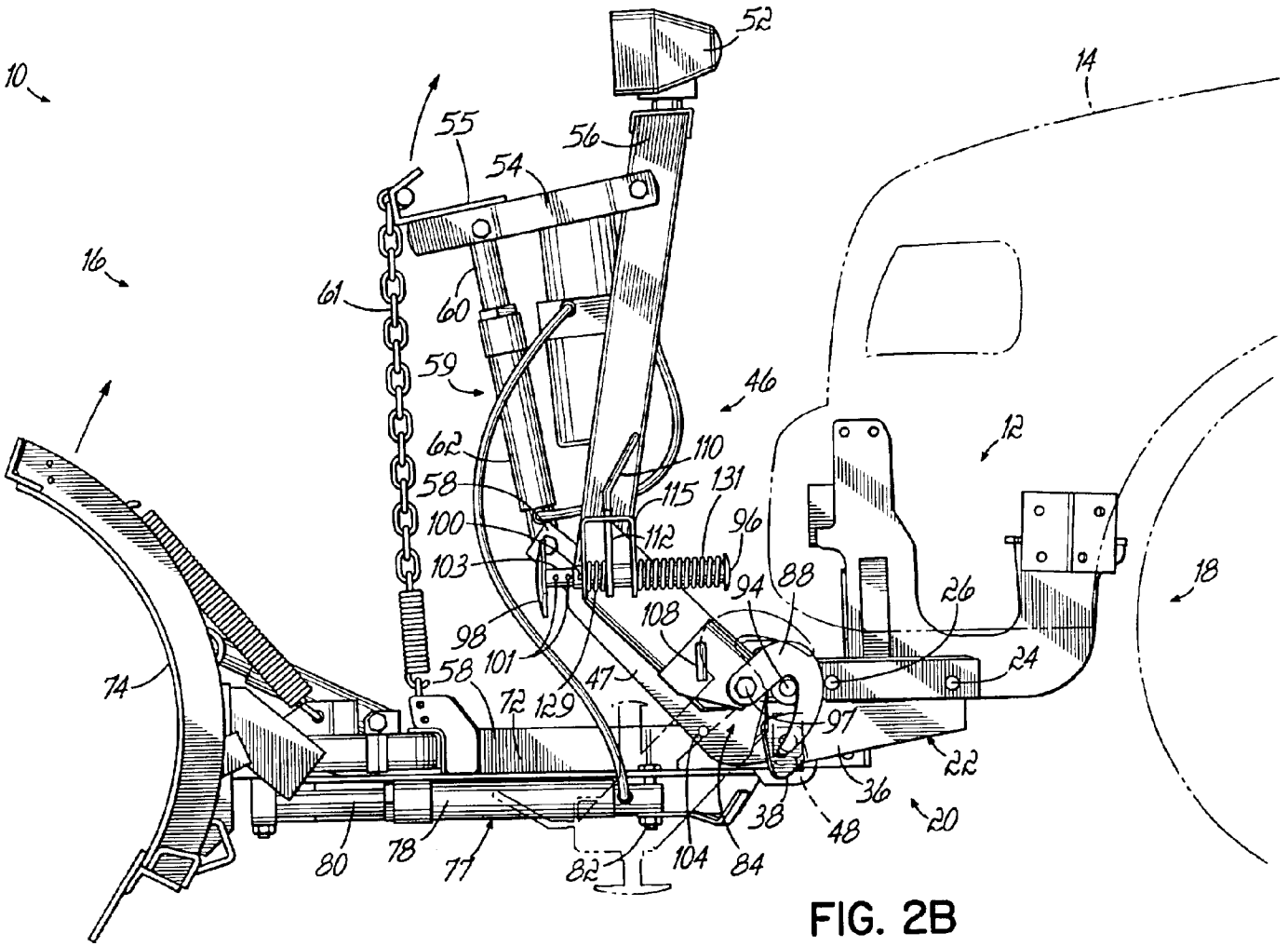
FIG. 2B is a side elevational view of the mount frame and snowplow assembly of FIG. 2A secured with one another with the snowplow blade in a down position.
Figure 2C:
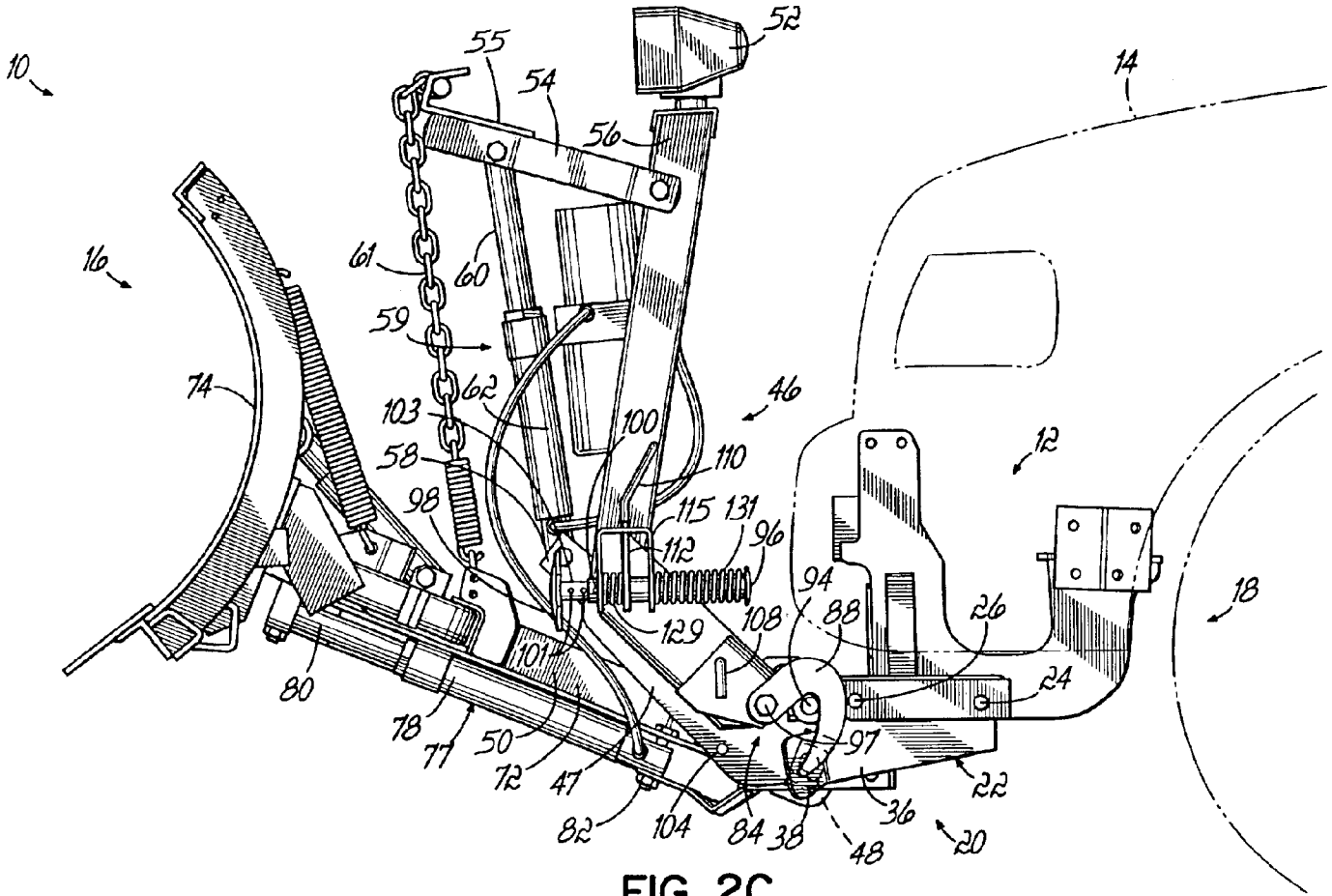
FIG. 2C is a view of the mount frame and snowplow assembly secured to one another like FIG. 2B but with the snowplow blade being raised to an up position.
Figure 4:
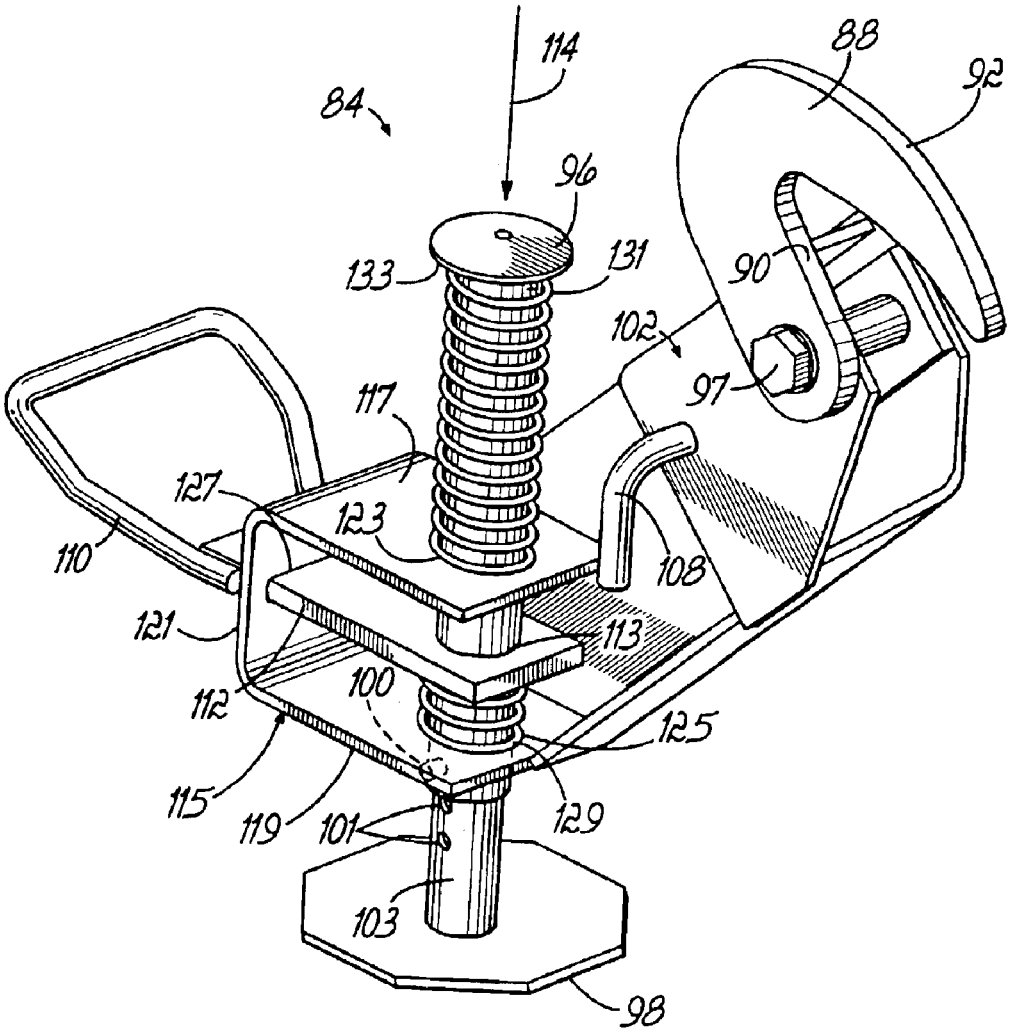
FIG. 4 is a perspective view of one of the stand assemblies of the present invention.

The lift frame 46 of the snowplow assembly 16 is supportable by a pair of stand assemblies 84 when the snowplow assembly 16 is separated from the vehicle 14 as illustrated in FIG. 2A. Each of the stand assemblies 84 is pivotable about a second horizontal transversely extending pivot axis 86 defined by bolt 97 securing stand assembly 84 to lift-frame 46, as illustrated in FIG. 1. Each of the stand assemblies 84 is independently pivotable about the axis 86 between a down position in which the stand assemblies 84 support the snowplow assembly 16 as illustrated in FIG. 2A and an up position illustrated in FIG. 2B in which the stand assemblies 84 do not support the snowplow assembly 16. As best illustrated in FIG. 4, each of the stand assemblies 84 has a latch hook 88 having a concave inner surface 90 and a convex outer surface 92. As illustrated in FIG. 2B, the latch hooks 88 are engageable with latch pins 94 (see also FIG. 1) which are a part of the mount frame 12. The latch pins 94 extend outwardly from the Outermost side plates 36 of the receivers 22 of the mount frame 12. The geometry and configuration of the pins 94, hooks 88 and bolts 97 (pivot axis 86) are such that, when engaged, pin 94 exerts a force on hook 88 which passes through bolt 97, i.e. pin 94 and hook 88 generate no moment load about bolt 97.

Each of the stand assemblies 84 has a locking assembly 102 which functions to lock the stand assembly in either the up position or the down position. At each side of the lift frame 46 at the lower portion 47 thereof there is a first hole 104 and a second hole 106, the second hole 106 being located above the first hole 104 (FIG. 2A). Holes 104 and 106 are located the same radial distance from axis 86, i.e. are on the same radius. Each stand assembly further comprises an L-shaped locking pin 108, illustrated in FIG. 4 as being within the first hole 104 of the lower portion 47 of the lift frame 46 of the snowplow assembly 16 (FIG. 2B). When the locking pin 108 is located inside the first hole 104, the stand assembly 84 is locked in the down position. In order to move the stand assembly 84 from the down position to the up position, a user must pull outwardly on the locking pin 108 before raising the stand assembly 84 to its up position. To lock the stand assembly 84 in its up position the locking pin 108 is located inside the second hole 106 of the lift frame 46 as illustrated in FIG. 2*d*. Preferably the locking pin is biased inwardly via a spring (not shown), i.e. is spring biased toward a locking position. Thus, a user need only pull outwardly on locking pin 108 to free the stand assembly 84 relative to the lift frame 46, move the stand assembly 84 to the desired position, i.e. either up or down, while maintaining locking pin 108 retracted, and then simply release the locking pin 108 which by action of the spring bias will automatically insert itself into either hole 104 or 106 as the case may be.

As illustrated in FIGS. 2A and 2B, to secure the snowplow assembly 16 to the mount frame 12 once the horns 42 of the snowplow assembly 16 are located in the receivers 22 of the mount frame 12, each of the stand assemblies 84 is pivoted upwardly about second transverse horizontal axis 86 (see FIG. 1) causing the latch hooks 88 to engage the latch pins 94 of the mount frame 12. The inner surfaces 90 of the latch hooks 88 surround the latch pins 94 of the mount frame 12 as illustrated in FIG. 2B. Advantageously, the latch hooks 88 and the latch pins 94 are so positioned and configured such that a camming action of hooks 88 upon pins 94 occurs thereby drawing the snowplow assembly 16 to the mount frame 12 and hence drawing horns 42 into receivers 22. And, as mentioned above, the resultant forces generated between hooks 88 and pins 94 pass through the transverse horizontal axis 86 defined by the bolt 97 and in doing so avoid generating a moment about the pivot axis 86. In doing so the stand 84 is prevented from subjecting locking pin 108 to a shear force during plowing motions which cause plow assembly 16 to tend to be "separated" from the vehicle. Such plowing motions can either be "back dragging," i.e., dragging plow blade 74 backwardly during "backing up" of the vehicle, or during "windrowing," i.e. plowing with only one lateral side of the blade 74. By preventing lock pin 108 from being a shear force carrying member during such plowing actions pin 108 can be designed much smaller in diameter than it otherwise could.

Describing each stand assembly 84 now in more detail, and as best illustrated in FIG. 4, each stand assembly 84 comprises a foot stand 96 and a foot 98 which telescopes into and out of the foot stand 96. The overall combined height of the foot stand 96 and foot 98 is set by passing a pin 100 through holes 101 in tube 103 of the foot 98 and through holes (not shown) in the foot stand 96. The position of pins 100 and hence the overall combined height of foot stand 96 and foot 98 are established by the dealer during initial installation of mount frame 12 and snowplow assembly 16 onto a particular vehicle and are dependent upon the particular vehicle on which the plow assembly 16 is to be mounted, the mount frame 12 for that particular vehicle, etc. Thereafter pins 100 are not adjusted.

Each of the stand assemblies 84 further comprises a mechanism to continuously or infinitely (within a range) adjust the height of the stand assembly 84 so that each of the stand assemblies has an independently, continuously adjustable height. Such an adjustment feature or mechanism is advantageous when parking snowplow assembly 16 on unlevel ground. Referring still to FIG. 4, a handle 110 is fixedly secured to a locking plate 112, which plate 112 has a hole 113 therein through which foot stand 96 passes. A C-shaped bracket 115 includes upper and lower plates 117 and 119 respectively interconnected by connecting plate 121. Foot stand 96 passes through holes 123, 125 in the plates 117, 119 respectively. Slot 127 in connecting plate 121 acts as a fulcrum pivotally supporting the locking plate 112. The locking plate 112 is normally biased upwardly by compression spring 129 operable between lower plate 119 of C-shaped bracket 115 and locking plate 112. Thus the edge of hole 113 in locking plate 112 "bites," or engages, and locks stand 96 in position vertically. A second compression spring 131 is operable between upper plate 117 of C-shaped bracket 115 and a stop 133 secured to an upper end of stand 96, normally biasing stand 96 to an upward position relative to C-shaped bracket 115.

In operation, and describing first the steps associated with attaching the snowplow assembly 16 to vehicle 14, snowplow assembly 16 is situated parked with stand assemblies 84 deployed. Vehicle 14 is "driven onto" snowplow assembly 16, i.e. horns 42 are driven into and received within receivers 22. Then, each handle 110 for each stand assembly 84 is lifted upwardly slightly, pivoting plate 112 downwardly against the biasing force of compression spring 129 thereby freeing foot stand 96 from the bite of the locking plate 112. Foot stand 96 is automatically driven upwardly in bracket 115 via compression spring 116. Pin 100 limits the upward travel of stand 96. Locking pin 108 is then pulled outwardly out of hole 104 (and retained there against the force of the spring bias). Handle 110 is then rotated upwardly thus rotating the freed stand 84 upwardly. This action causes hooks 88 to "cam" against pins 94 thereby "camming" the snowplow assembly 16 toward the mount frame 12. Once in the fully up (and latched) position, locking pin 108 is released and automatically inserts into hole 106. After these steps are performed for each stand assembly 84, and the vehicle wiring harness (not shown) is connected to the snowplow wiring harness (not shown) the vehicle 14 may be driven off with snowplow assembly 16 attached thereto.

Describing now the steps associated with detattaching the snowplow assembly 16 from vehicle 14, snowplow assembly 16 is situated attached to mount frame 12, with stand assemblies 84 in their up (and latching) positions. Locking pin 108 is retracted from hole 106 and is held there against the force of its spring bias while freed stand assembly 84 is pivoted downwardly with handle 110. Once stand assembly 84 is in the fully down position locking pin 108 is released and automatically inserts into hole 104 thereby locking stand assembly 84 in the down position. The foot stand 96 is then pressed downwardly as by the action of an operator's hand or foot on disk or stop 133 in the direction of arrow 114, until the foot 98 contacts the ground surface. After these steps are performed for each stand assembly 84, and the vehicle wiring harness is disconnected from the snowplow wiring harness, the vehicle 14 may then be backed away from snowplow assembly 16.

To facilitate and ease reattachment of snowplow assembly 16 to vehicle 14, it is desirable that the horns 42 of lift frame 46, after snowplow assembly 16 is detached from vehicle 14, remain positioned so as to still be aligned with receivers 22 of mount frame 12 during reattachment, i.e. during "drive on" of the vehicle 14 and mount frame 12 to the snowplow assembly 16. The ability of the A-frame 50 and hence blade 74 to pivot about the longitudinal, horizontal axis 68 relative to the rest of the snowplow assembly 16, and the independently and continuously or infinitely adjustable height feature of the stands 96, greatly facilitates this later reattachment of the snowplow assembly 16 to the vehicle 14, when the snowplow assembly 16 has been parked on uneven terrain and detached from the vehicle 14. During detachment, by incorporating the pivot axis 68 the blade 74 can naturally pivot, independently of the lift frame 46, as it is lowered onto the ground surface so as to be supported at both ends, i.e. supported at two spaced points along the width of the blade 74. The lift frame 46 can likewise be supported at both transverse sides by stands 96, which may require extending one of the stands 96 downwardly (relative to the lift frame 46) further than the other stand 96 depending on the terrain. With blade 74 and lift frame 46 so supported, horns 42 will remain generally stationary during withdrawal of receivers 22 from horns 42 as vehicle 14 is backed away from snowplow assembly 16, and thus will remain generally parallel to and vertically aligned with the receivers 22. In other words, snowplow assembly 16 will generally undergo no "shifting" upon backing vehicle 14 away therefrom, as the blade 74 and frame 46 have already "reached equilibrium" prior thereto by virtue of the pivot axis 68 and stands 96. Accordingly, when an operator of the vehicle 14 returns the vehicle 14 to the parked snowplow assembly 16, the horns 42 will already be aligned with receivers 22 (at least within a margin of error correctable by the flared portions of the receivers 22) and vehicle 14 and mount 12 can readily be driven back onto horns 42 and snowplow assembly 16.

An additional advantage of the ability of blade 74 to pivot about the longitudinal, horizontal axis 68 during operation is that it provides a "hugging" action of the blade 74 to the ground surface to provide a cleaner scrape and more even plow blade cutting edge wear.

While we have described one preferred embodiment of this invention, persons skilled in the art to which it applies will appreciate changes and modifications which may be made without departing from the spirit of the invention. For example, while the preferred latching mechanism of latching snowplow assembly to mount frame has been described herein as being latch hooks cooperating with latch pins, many other latching mechanisms incorporating cooperating latching elements other than hooks and pins may be used in the practice of the present invention and yet still be within the scope thereof. For another example, while the preferred construction of the snowplow assembly according to the principles of the present invention has been described herein as being comprised of a plow blade, an A-frame, a trunnion and a lift frame, other elements or subassemblies, and both greater in number and fewer in number, than those described and illustrated, may be employed in the practice of the present invention and yet still be within the scope thereof. As yet another example, while the term "A-frame" has been used herein, it is to be understood that other configurations of frames other than "A's" may be substituted therefore in the practice of the present invention and yet still be within the scope thereof. Therefore, we do not intend to be limited except by the scope of the following claims and their equivalents.

We claim:

1. A snowplow assembly comprising:

a lift frame;

a trunnion pivotally connected to said lift frame for pivoting movement about a transverse, horizontal axis;

an A-frame having a plow blade on a forward end and being pivotally connected on a rearward end to said trunnion for pivoting movement about a longitudinal, horizontal axis; and a motion generating device for effecting relative movement between said A-frame and lift frame for pivoting movement about the transverse, horizontal axis;

said lift frame, trunnion, A-frame and motion generating device all being attachable to and detachable from a vehicle as one assembly.

2. The snowplow assembly of claim 1 further including a pair of transversely spaced support stands mounted to said lift frame, each support stand being height adjustable independently of the other.

3. A snowplow assembly comprising:

a lift frame;

a plow blade;

a motion generating device for effecting relative movement between said lift frame and plow blade for pivoting movement of the plow blade about a transverse, horizontal axis; and a pair of transversely spaced stand assemblies mounted to said lift frame, each said stand assembly comprising:

said snowplow assembly being releasably securable to said mount frame, said snowplow assembly including a lift frame supportable by a stand, said stand being pivotal about a horizontal pivot axis between a down position in which said stand supports said snowplow assembly and an up position in which said stand does not support said snowplow assembly, said stand having a second latch element selectively engageable with said first latch element of said mount frame, wherein said first and second latch elements are engaged with one another to secure said snowplow assembly to said mount frame when said stand is in said up position, and disengaged with one another when said stand is in said down position to allow said mount frame to separate from said snowplow assembly.

4. A snowplow assembly comprising:

a lift frame;

a trunnion connected to said lift frame;

an A-frame having a plow blade on a forward end and being connected on a rearward end to said trunnion; and a motion generating device far effecting relative movement between said A-frame and lift frame;

said lift frame, trunnion, A-frame and motion generating device all being attachable to and detachable from a vehicle as one assembly;

said lift frame, trunnion and A-frame being pivotally connected in such a manner that said A-frame can pivot relative to said lift frame about a transverse, horizontal axis as well as can pivot relative to said lift frame about a longitudinal, horizontal axis.

5. The snowplow assembly of claim 4 wherein said trunnion is pivotally connected to said lift frame for pivoting motion about a transverse, horizontal axis and said A-frame is pivotally connected to said trunnion for pivoting motion about a longitudinal horizontal axis.

6. A snowplow assembly comprising:

a lift frame;

a trunnion connected to said lift frame;

an A-frame having a plow blade on a forward end and being connected on a rearward end to said trunnion; and a motion generating device for effecting relative movement between said A-frame and lift frame;

said lift frame, trunnion, A-frame and motion generating device all being attachable to and detachable from a vehicle as one assembly;

said lift frame, trunnion, A-frame and plow blade being pivotally connected in such a manner that said plow blade can pivot relative to said lift frame about a transverse, horizontal axis as well as can pivot relative to said lift frame about a longitudinal, horizontal axis.

7. The snowplow assembly of claim 6 wherein said trunnion is pivotally connected to said lift frame for pivoting motion about a transverse, horizontal axis and said A-frame is pivotally connected to said trunnion for pivoting motion about a longitudinal, horizontal axis.

8. A snowplow assembly comprising:

a lift frame;

a trunnion connected to said lift frame;

an A-frame having a plow blade on a forward end and being connected on a rearward end to said trunnion;

a motion generating device for effecting relative movement between said A-frame and lift frame;

said lift frame, trunnion, A-frame and plow blade being pivotally connected in such a manner that said plow blade can pivot relative to said lift frame about a transverse, horizontal axis as well as can pivot relative to said lift frame about a longitudinal, horizontal axis; and a pair of transversely spaced support stands mounted to said lift frame for supporting said snowplow assembly above a ground surface during detachment from a vehicle, each of said support stands being height adjustable independently of the other said support stand.

9. The snowplow assembly of claim 8 wherein each of said support stands is continuously height adjustable.

10. A snowplow assembly comprising:

a lift frame;

a plow blade;

a motion generating device for effecting relative movement between said lift frame and said plow blade; and a pair of transversely spaced support stands mounted to said lift frame for supporting said lift frame above a ground surface, each of said pair of stands being height adjustable independently of the other of said stands.

11. The snowplow assembly of claim 10 wherein each of said support stands is continuously height adjustable.

12. The snowplow assembly of claim 10 wherein said lift frame, plow blade and motion generating device are adapted to be attached to and detached from a vehicle as a single assembly.

13. The snowplow assembly of claim 10 wherein said plow blade is operable to pivot relative to said lift frame about a longitudinal, horizontal axis.

14. The snowplow assembly of claim 10 wherein said plow blade is operable to pivot relative to said lift frame about a longitudinal, horizontal axis.

15. A snowplow assembly comprising;

a lift frame;

a plow blade;

a motion generating device for effecting relative movement between said lift frame and said plow blade; and a pair of transversely spaced support stands mounted to said lift frame for supporting said lift frame above a ground surface, each of said pair of stands being height adjustable independently of the other of said stands;

wherein each said support stand comprises:

a bracket having opposed first and second plates and a hole in each said plate;

a leg passing through said holes in said first and second plates of said bracket;

a pivoting locking plate positioned intermediate said first and second plates of said bracket, said locking plate having a hole therein, said leg passing through said locking plate hole, said locking plate including a handle facilitating manual pivoting of said locking plate relative to said bracket;

a first spring normally biasing an edge of said locking plate hole against said leg thereby locking said leg relative to said bracket, said handle being operable to pivot said locking plate such that said locking plate hole edge is out of engagement with said leg thereby freeing said leg for movement relative to said bracket; and a second spring normally biasing said leg relative to said bracket.

16. The snowplow assembly of claim 15 wherein said first spring is operable between one of said first and second plates of said bracket and said locking plate.

17. The snowplow assembly of claim 16 wherein said second spring is operable between the other of said first and second plates of said bracket and said leg.

18. A snowplow assembly comprising:

a lift frame;

a plow blade, said plow blade being pivotal relative to said lift frame about a longitudinal, horizontal axis; and a motion generating device for effecting relative movement between said lift frame and said plow blade;

said lift frame, plow blade and motion generating device being adapted to be attached to and detached from a vehicle as a single assembly.

* * * * *

UNITED STATES PATENT AND TRADEMARK OFFICE

CERTIFICATE OF CORRECTION

PATENT NO. : 6,928,757 B2
APPLICATION NO. : 10/339116
DATED : August 15, 2005
INVENTOR(S) : David N. Bloxdorf et al.

It is certified that error appears in the above-identified patent and that said Letters Patent is hereby corrected as shown below:

Column 2, Cover Page, line 18, reads: "300 Series, Brochure, 1999."; it should read -- 3000 Series, Brochure, 1999. --

Column 3, line 59, reads: "welded to first portion 18 in rearward most hole 28. A"; should read -- welded to first portion 18 in rearwardmost hole 28. A --

Column 3, line 61, reads: "forward most hole 28 in first portion 18 and accepts remove-"; it should read: -- forwardmost hole 28 in first portion 18 and accepts remove --

Column 4, line 2, reads: "wrenches, sockets, etc are required to quickly and readily"; it should read -- wrenches, sockets, etc. are required to quickly and readily --

Column 5, line 37, reads: "extend outwardly from the Outermost side plates 36 of the"; it should read -- extend outwardly from the outermost side plates 36 of the --

Column 5, line 61, reads: "as illustrated in FIG. 2d. Preferably the locking pin is biased"; it should read -- as illustrated in FIG. 2B. Preferably the locking pin is biased --

Column 7, line 25, reads: "Describing now the steps associated with deattaching the"; it should read -- Describing now the steps associated with detaching the --

Column 9, lines 5-19, Claim 3, should be deleted. The following lines should be added in their place:

a C-shaped bracket having opposed upper and lower plates and a hole in each said plate;

a stand leg with a stand foot secured to a lower end of said stand leg, said stand leg passing through said holes in said upper and lower plates of said C-shaped bracket;

a pivoting locking plate positioned intermediate said upper and lower plates of said C-shaped bracket, said locking plate having a hole therein, said stand leg passing through said locking plate hole, said locking plate including a handle facilitating manual pivoting of said locking plate relative to said C-shaped bracket;

Signed and Sealed this

Third Day of August, 2010

David J. Kappos

David J. Kappos
*Director of the United States Patent and Trademark Office* a first spring operable between said lower plate of said C-shaped bracket and said locking plate normally biasing an edge of said locking plate hole against said stand leg thereby locking said stand leg relative to said C-shaped bracket, said handle being operable to pivot said locking plate such that said locking plate hole edge is out of engagement with said stand leg thereby freeing said stand leg for movement relative to said C-shaped bracket; and a second spring operable between said upper plate of said C-shaped bracket and said stand leg normally biasing said stand leg to an up position.

Column 9, line 26, Claim 4, reads: "a motion generating device far effecting relative move-"; it should read: -- a motion generating device for effecting relative move- --

Column 9, line 40, Claim 5, reads: "about a longitudinal horizontal axis."; it should read: -- about a longitudinal, horizontal axis. --

Column 10, line 36, Claim 14, reads: "14. The snowplow assembly of claim 10 wherein said"; it should read: -- 14. The snowplow assembly of claim 11 wherein said --